US009393459B2

(12) United States Patent
Savarino

(10) Patent No.: US 9,393,459 B2
(45) Date of Patent: Jul. 19, 2016

(54) REMOVABLE SHOULDER STOP ASSEMBLY WITH LOCKING MECHANISM

(71) Applicant: Balanced Body, Inc., Sacramento, CA (US)

(72) Inventor: Christopher J. Savarino, Sacramento, CA (US)

(73) Assignee: Balanced Body, Inc., Sacramento, CA (US)

( * ) Notice: Subject to any disclaimer, the term of this patent is extended or adjusted under 35 U.S.C. 154(b) by 36 days.

(21) Appl. No.: 14/510,335

(22) Filed: Oct. 9, 2014

(65) Prior Publication Data

US 2015/0119213 A1 Apr. 30, 2015

Related U.S. Application Data

(60) Provisional application No. 61/895,173, filed on Oct. 24, 2013.

(51) Int. Cl.

| | |
|---|---|
| ***A63B 26/00*** | (2006.01) |
| ***A63B 22/00*** | (2006.01) |
| ***A63B 21/02*** | (2006.01) |
| ***A63B 69/00*** | (2006.01) |

(Continued)

(52) U.S. Cl.

CPC ..... *A63B 22/0087* (2013.01); *A63B 21/02* (2013.01); *A63B 22/0046* (2013.01); *A63B 22/0089* (2013.01); *A63B 69/0057* (2013.01); *A63B 21/00065* (2013.01); *A63B 21/023* (2013.01); *A63B 21/0428* (2013.01); *A63B 21/055* (2013.01); *A63B 2210/50* (2013.01); *Y10T 74/20636* (2015.01)

(58) Field of Classification Search

CPC ..... A63B 22/0087; A63B 22/0089; A63B 69/0057; A63B 21/02; A63B 21/0428; A63B 21/055; A63B 21/00065; A63B 21/023; A63B 2210/50; A63B 22/46; A63B 21/50; Y10T 403/7037; Y10T 403/7015

USPC ..... 248/220.22, 221, 223.31, 222.41

See application file for complete search history.

(56) References Cited

U.S. PATENT DOCUMENTS 4,630,982 A * 12/1986 Fenner ..... B61D 45/001 24/265 CD 5,653,670 A 8/1997 Endelman (Continued)

FOREIGN PATENT DOCUMENTS

WO WO 00-53267 9/2000

OTHER PUBLICATIONS

International Search Report and Written Opinion, dated Jan. 19, 2015, from corresponding International Patent Application No. PCT/US2014/059837.

*Primary Examiner* — Oren Ginsberg
*Assistant Examiner* — Megan Anderson
(74) *Attorney, Agent, or Firm* — Greenberg Traurig, LLP

(57) ABSTRACT

A removable locking shoulder stop assembly for use on a reformer exercise apparatus is disclosed that includes a flat rectangular lock plate fastenable to the platform adjacent the head rest on the carriage platform. The lock plate has a first locating member and a keyway spaced from the first locating member. An L-shaped shoulder stop bracket has a second locating member configured to mate with the first locating member of the lock plate. An elongated locking handle assembly is connected to the mounting portion of the bracket and spaced apart from the second locating member. The handle assembly aligns with the keyway when the first locating member is mated with the second locating member and is operable to clamp the shoulder stop bracket to the lock plate when the locating members are mated and the locking handle assembly is hand tightened against the mounting portion of the shoulder stop bracket.

12 Claims, 7 Drawing Sheets

(51) Int. Cl.

| | |
|---|---|
| *A63B 21/055* | (2006.01) |
| *A63B 21/04* | (2006.01) |
| *A63B 21/00* | (2006.01) |

(56) References Cited

U.S. PATENT DOCUMENTS

| | | | | |
|---|---|---|---|---|
| 5,681,249 | A | 10/1997 | Endelman | |
| 6,186,929 | B1 * | 2/2001 | Endelman | A63B 21/023 482/101 |
| 6,527,685 | B2 * | 3/2003 | Endelman | A63B 21/023 482/121 |
| 7,465,261 | B2 * | 12/2008 | Barnard | A63B 22/0007 482/121 |
| 8,646,843 | B2 * | 2/2014 | Koch | A47C 17/02 297/440.14 |
| 2013/0017935 | A1 | 1/2013 | Endelman et al. | |

* cited by examiner

REMOVABLE SHOULDER STOP ASSEMBLY WITH LOCKING MECHANISM

CROSS REFERENCE TO RELATED APPLICATIONS

This application claims the benefit of priority of U.S. Provisional Patent Application Ser. No. 61/895,173 filed Oct. 24, 2013, the content of which is incorporated by reference herein in its entirety.

BACKGROUND OF THE DISCLOSURE

This disclosure relates to exercise equipment, and in particular to removable shoulder stops for a reformer type of exercise equipment.

A reformer is an exercise apparatus first developed by Joseph H. Pilates in the last century. A typical reformer has a rectangular frame and a wheeled carriage riding back and forth along the sides of the frame. The carriage is biased toward a foot end of the frame usually by one or more coil springs and has a generally flat cushioned upper surface. The carriage is structured to support a user's body in a sitting, standing or reclining position. The carriage usually has a pair of shoulder stops and a head rest at one end, opposite the foot end of the frame, to support the shoulders and head of a user when reclined on the carriage.

The shoulder stops may be permanently attached to the carriage or may be removable. Removable shoulder stops may be desired in order to facilitate moving or storage of the equipment in a compact configuration, or when the carriage is being used for exercises in which the shoulder stops are in the way. However, removable shoulder stop suffer from a tendency to "wobble" during use. Therefore, there is a need for a shoulder stop assembly configuration that ensures that such removable shoulder stops are solidly secured in place on the apparatus to which they are installed.

SUMMARY OF THE DISCLOSURE

One embodiment of a removable shoulder stop assembly in accordance with the present disclosure includes a flat rectangular lock plate that is securely fastened to the upper surface of the reformer carriage, an L-shaped shoulder pad stop bracket, a shoulder pad, and a locking handle assembly. The flat rectangular lock plate is fastenable to a planar surface of the carriage and has a first locating member and a keyway spaced from the first locating member. The L-shaped shoulder stop bracket has a pad support portion and a mounting portion generally perpendicular to the pad support portion. The mounting portion has a second locating member configured to mate with the first locating member. The shoulder pad is fastened to the pad support portion of the shoulder stop bracket. The locking handle assembly is mounted on the mounting portion of the bracket and spaced apart from the second locating member so as to align in registry with the keyway when the first locating member is mated with the second locating member. The locking handle assembly is operable to clamp the shoulder stop bracket to the lock plate when the locating members are mated and the locking handle assembly is hand tightened against the mating portion of the shoulder stop bracket.

Preferably a pair of shoulder stop assemblies in accordance with the present disclosure are be mounted to the upper surface of the movable body support carriage of a reformer exercise apparatus. In one embodiment each of the rectangular lock plates preferably has a pair of keyway slots therein aligned parallel to a long central axis of the rectangular lock plate but laterally offset from the long central axis of the rectangular locking plate. This permits the pair of shoulder stop brackets to be positioned in a first spaced apart relationship when installed on either side of the carriage head rest, and a different spaced relationship when swapped to the other side of the head rest.

The first locating member is laterally spaced from the central axis, and the keyway is preferably aligned with the first locating member parallel to the central axis. In some embodiments, the keyway is a first keyway and the first locating member is a second keyway. In other embodiments, the keyway is a first keyway and the second locating member is a second keyway. In some embodiments, the second locating member is a key pin.

One embodiment of a removable locking shoulder stop assembly includes a flat rectangular lock plate fastenable to a surface portion of the platform adjacent the head rest at the one end of the carriage platform. The lock plate has a first locating member and a keyway spaced from the first locating member. The assembly also includes an L-shaped shoulder stop bracket having a pad support portion and a mounting portion generally perpendicular to the pad support portion. The mounting portion has a second locating member configured to mate with the first locating member of the lock plate. Lastly the assembly includes an elongated locking handle assembly connected to the mounting portion of the bracket and spaced apart from the second locating member. This handle assembly aligns with the keyway when the first locating member is mated with the second locating member. The handle assembly is operable to clamp the shoulder stop bracket to the lock plate when the locating members are mated together. The handle assembly is hand tightened against the mounting portion of the shoulder stop bracket.

The rectangular lock plate of the removable shoulder stop assembly in one embodiment is a fairly thick plate with a recess in an underside of the plate to accommodate locating member pins in the keyways from the stop bracket. In other embodiments, the lock plate has a flat bottom with no recess, and the carriage platform includes a recess to accommodate the pins in the keyways protruding through the locking plate.

The handle assembly preferably includes a cylindrical sleeve handle threaded onto a bolt. The head of the bolt protrudes from a bottom end of the handle and is sized to fit within and be held in the keyway in the lock plate when the cylindrical sleeve handle of the handle assembly is tightened to fasten the bracket to the lock plate. One embodiment of the bolt also carries on it a pair of washers sandwiching a spacer therebetween. This spacer is sized to slide within the key portion of the keyway in the lock plate, and when the handle, threaded onto the bolt, is tightened the shoulder stop bracket is drawn tightly against the lock plate to secure the shoulder stop to the carriage.

BRIEF DESCRIPTION OF THE DRAWINGS

These and other features and advantages of the various embodiments disclosed herein will be better understood with respect to the following description and drawings in which like numbers refer to like parts throughout and in which.

DETAILED DESCRIPTION

Figure 1:
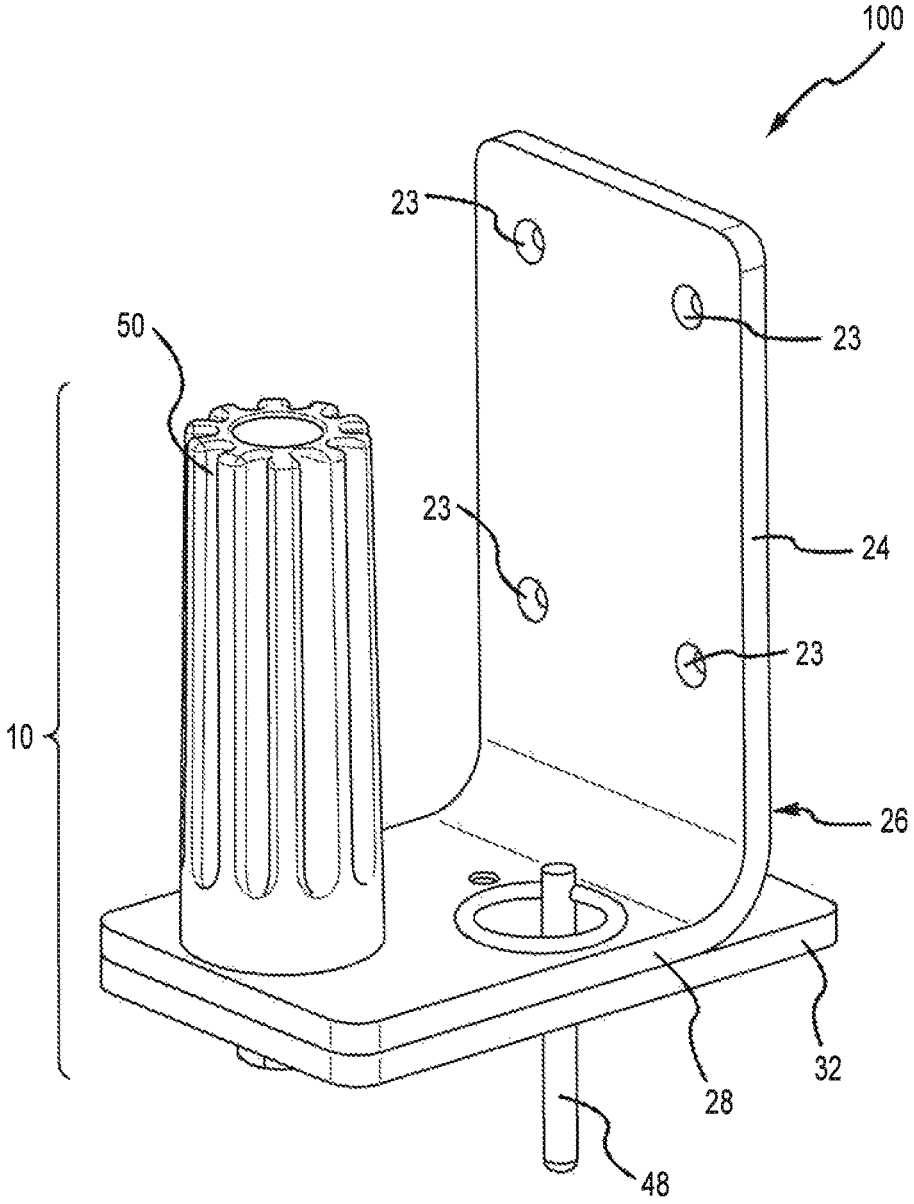
FIG. 1 is a perspective top view of a removable shoulder stop assembly in accordance with an aspect of the present invention.
Figure 2:
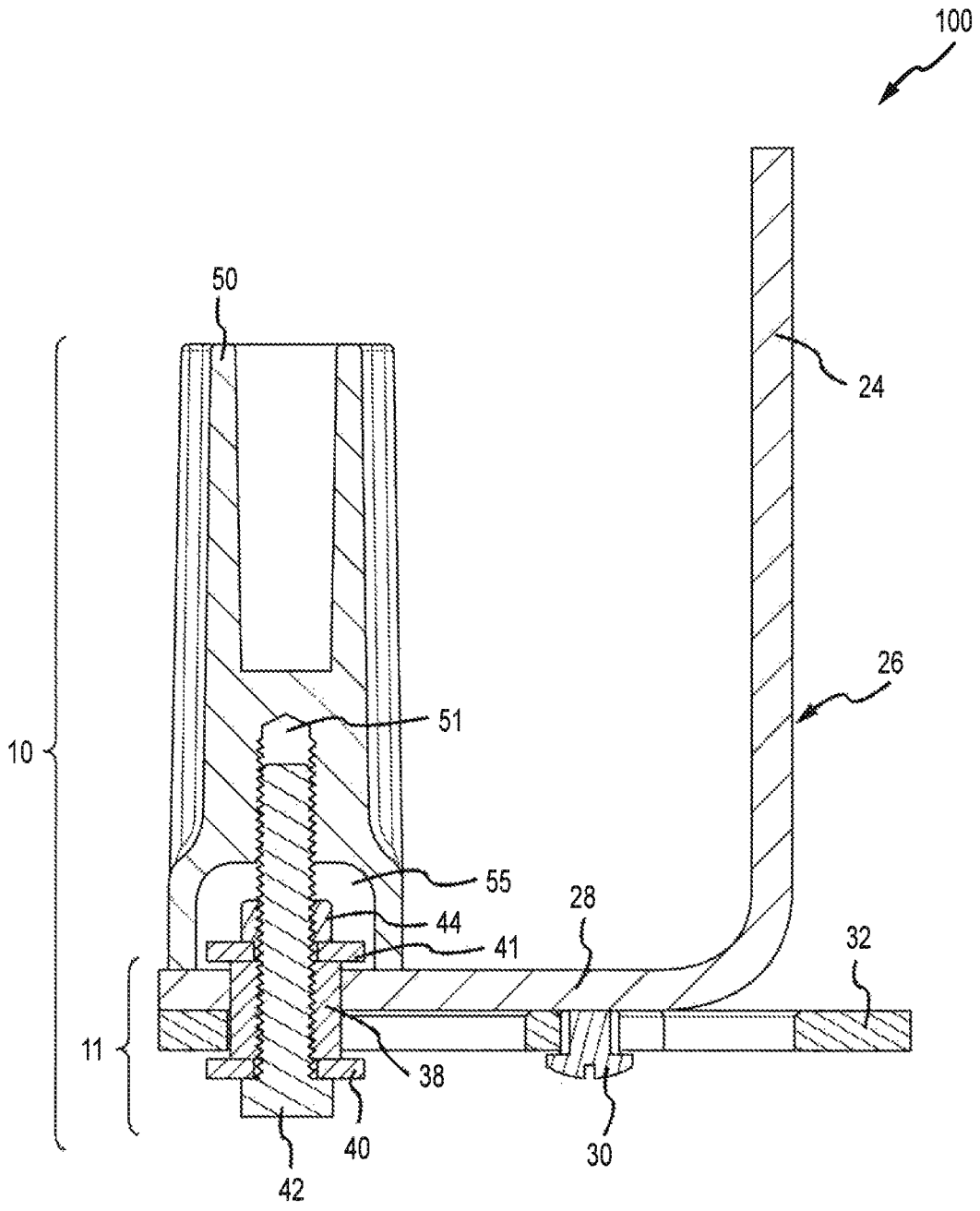
FIG. 2 is a cross section of the removable shoulder stop assembly of FIG. 1.
Figure 3:
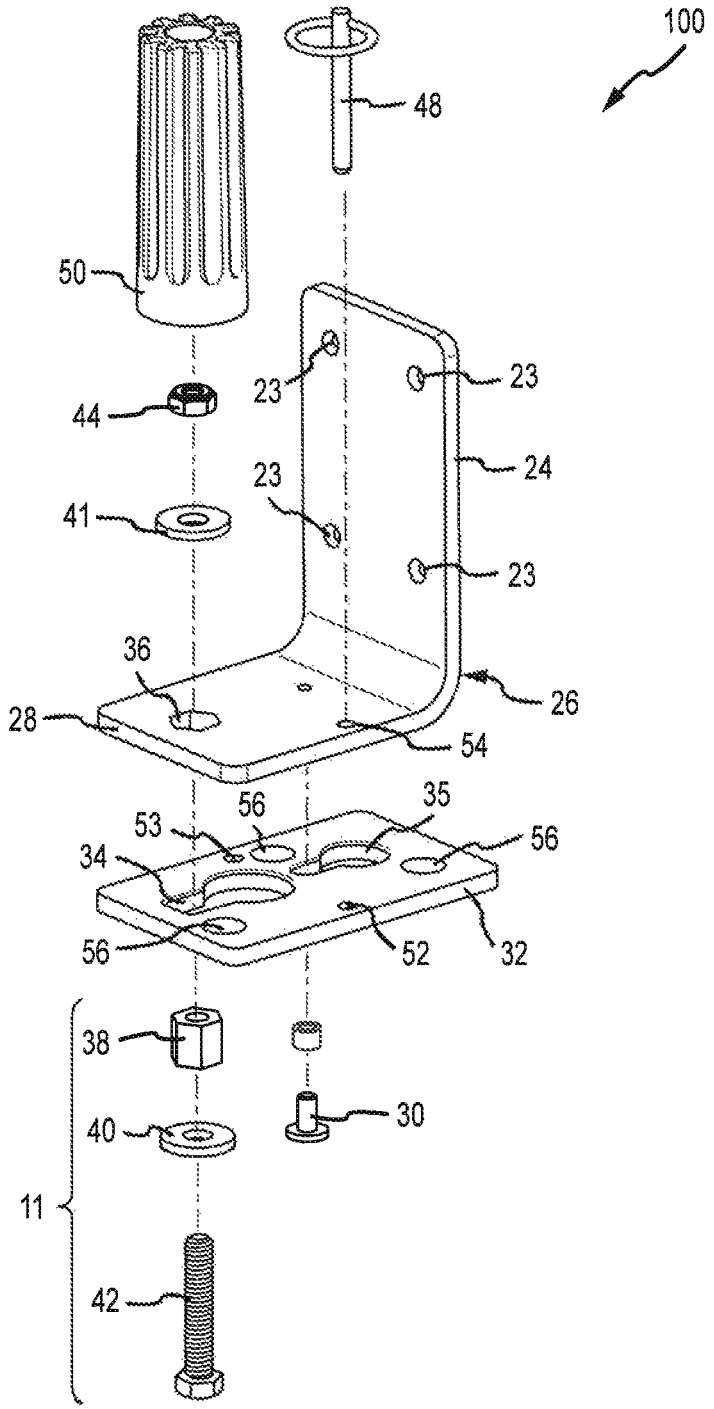
FIG. 3 is a perspective top exploded view of the removable shoulder stop assembly of FIGS. 1-2.

A removable shoulder stop assembly 100 in accordance with a first embodiment of the present disclosure is shown in FIGS. 1-3. As shown in FIG. 1, the removable shoulder stop assembly 100 comprises an L-shaped shoulder stop bracket 26 removably mounted to a flat rectangular lock plate 32. The shoulder stop bracket 26 comprises a pad support flange 24 and a mounting flange 28. A locking handle assembly 10, comprising a handle 50 and locking key pin 11 having a broad head and a narrow shaft, is mounted through the mounting flange 28 such that the handle 50 protrudes from the upper side of the mounting flange 28 and the locking key pin 11 protrudes from the underside of the mounting flange 28.

The lock plate 32 includes a first keyway 34 and a first locating member. The mounting flange 28 includes a second locating member complementary to the first locating member. The locking key pin 11 is complementary to the first keyway 34. In the illustrated embodiment, the first locating member is a second keyway 35 and the second locating member is a second, non-locking key pin 30. This key pin 30 has a broad head and a narrow shaft and protrudes from the underside of the mounting flange 28. Each of the keyways 34, 35 comprise a round orifice and a slot. The keyways 34, 35 are spaced to receive the locking key pin 11 and the key pin 30, respectively. A user may mount the shoulder stop bracket 26 to the lock plate 32 by mating the key pins 11, 30 with their respective keyways 34, 35. This can be accomplished by: first, aligning the key pins 11, 30 with their respective keyways 34, 35; then causing the heads of the key pins to pass through the round orifices of the respective keyways 34, 35 by lowering the shoulder stop bracket 26 onto the lock plate 32; and finally, causing the narrow shafts of the key pins 11, 30 to slide into the slots of the respective keyways 34, 35 by sliding the shoulder stop bracket 26 in the direction of the slots.

When the key pins 11, 30 are mated with their respective keyways 34, 35, the locking handle assembly 10 is operable to clamp the shoulder rest bracket 26 to the lock plate 32 by retracting the locking key pin 11 towards the handle 50. Thus, a user may secure the shoulder rest bracket 26 to an exercise apparatus, or any other apparatus that might benefit from securely mounted yet easily removable shoulder stops.

In the illustrated embodiment of FIGS. 1-3, the locking handle assembly 10 comprises a handle 50 and a threaded bolt 42. The handle 50 comprises an elongated cylinder having a bowl-shaped cavity 55 in one end. A central bore 51, configured to accept the bolt 42 (e.g., having complementary threads and diameter to those of the bolt), begins at the bottom of the bowl-shaped cavity 55 and extends axially through the handle 50 toward the opposite end of the cylinder. In this embodiment, the locking key pin 11 of the locking handle assembly 10 is comprised of a spacer nut 38, a first washer 40, and the bolt 42. The spacer nut 38 may alternatively be a threaded or unthreaded sleeve or tube. However, in this embodiment, a spacer nut 38 is shown. The locking handle assembly 10 further comprises a lock nut 44 and a second washer 41. Both the spacer nut 38 and the lock nut 44 have complementary threads to those of the bolt 42. Both of the washers 40, 41 are sized to receive the bolt 42.

The locking handle assembly 10 may be mounted to the shoulder stop bracket 26 via a hexagonally-shaped hole 36 in the mounting flange 28 as follows. First, the first washer 40 is slipped onto the bolt 42, then the spacer nut 38 is screwed onto the bolt 42 and tightened until the spacer nut 38 squeezes the first washer 40 against the head of the bolt 42. Next, the shaft of the bolt 42, including the spacer nut 38, is inserted into the hexagonally-shaped hole 36 in the mounting flange 28 of the shoulder stop bracket 26. Next, the second washer 41 is slipped onto the bolt 42, then the lock nut 44 is screwed onto the bolt 42 and tightened until the lock nut 44 squeezes the second washer 41 against the spacer nut 38, thereby securely sandwiching the spacer nut 38 between the first and second washers 40, 41. Finally, the shaft of the bolt 42 is screwed into the central bore 51 of the handle 50 until the bowl-shaped cavity 55 engulfs the lock nut 44 and the second washer 41, thereby bringing the rim of the bowl-shaped cavity 55 into contact with the upper face of the mounting flange 28.

The hexagonally-shaped hole 36 is sized to allow the spacer nut 38 to slide up and down inside the hexagonally-shaped hole 36, while at the same keeping the spacer nut 38 from rotating axially. The washers 41, 42 prevent the spacer nut 38, and hence the bolt 42, from sliding out of the hexagonally shaped hole 36. Further, the lock nut 44 prevents the spacer nut 38 from rotating independently of the bolt 42. Hence, the bolt 42 and spacer nut 38 are free to slide up and down in the hexagonally shaped hole 36 between the washers 40, 41, but not to rotate therein. Thus, when the handle 50 is mounted with the rim of the bowl-shaped cavity 55 contacting the upper face of the mounting flange 28 as described above, hand tightening of the handle 50 causes the locking key pin 11 to retract into the handle 50, thereby clamping the lock plate 32 to the mounting flange 28.

The shoulder stop bracket 26 may support a cushion pad 20. The cushion pad 20 may be secured to the shoulder stop bracket 26 via pad mounting holes 23 in the pad support flange 24.

In one embodiment, the removable shoulder stop assembly 100 may include a clevis pin 48. When the key pins 11, 30 are mated with their respective keyways 34, 35, the clevis pin 48 may be inserted through a clevis pin hole 54 in the mounting flange 28 and then through a complementary clevis pin hole 52 in the lock plate 32, thereby preventing the mounting flange 28 from sliding relative to the lock plate 32. Thus, when the clevis pin 48 is in place, the key pins 11, 30 are prevented from sliding out of the slots of the keyways 34, 35. In other embodiments, the clevis pin 48 may be omitted.

Figure 4:
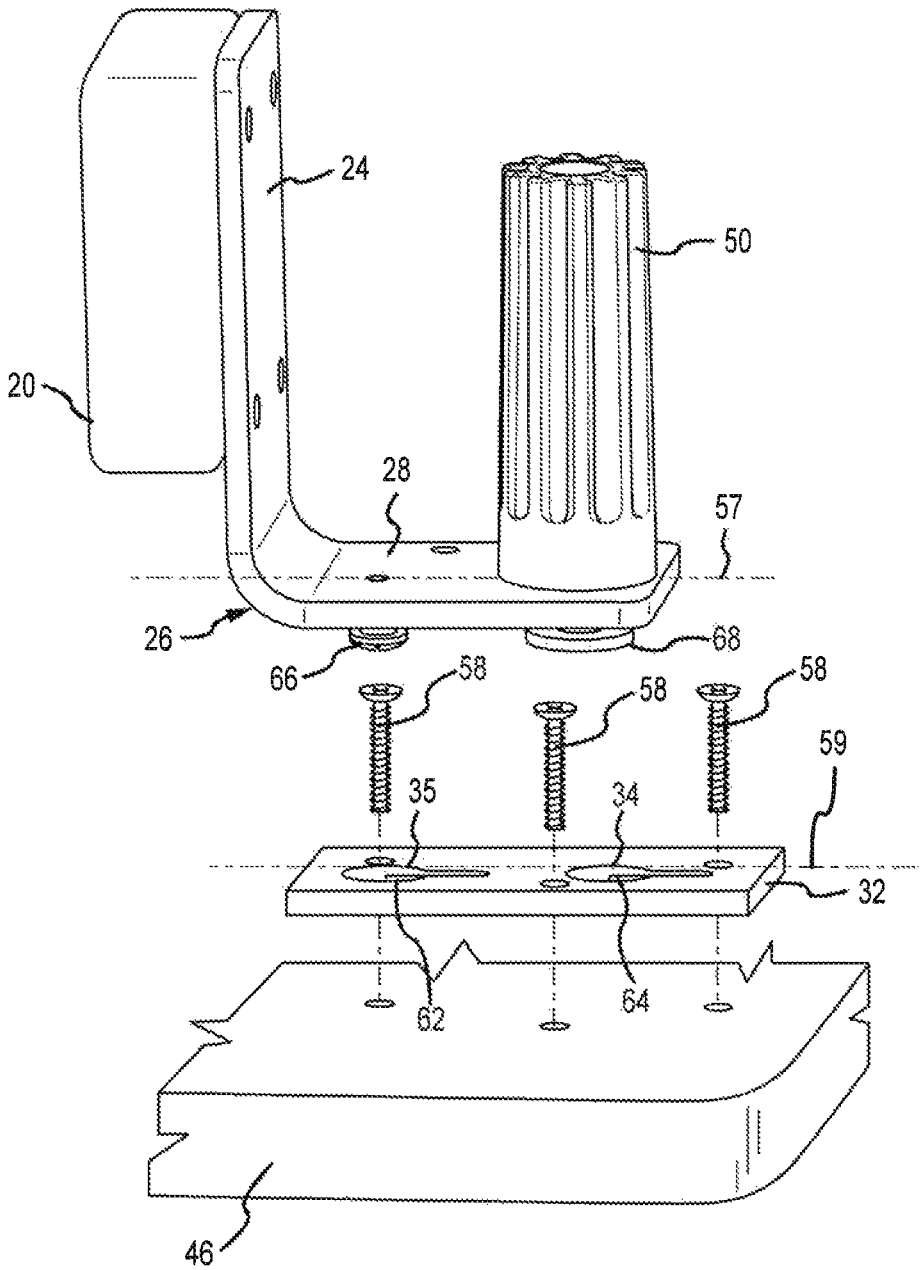
FIG. 4 is a perspective top exploded view of a removable shoulder stop assembly mountable to an exercise apparatus in accordance with an aspect of the present invention.
Figure 5:
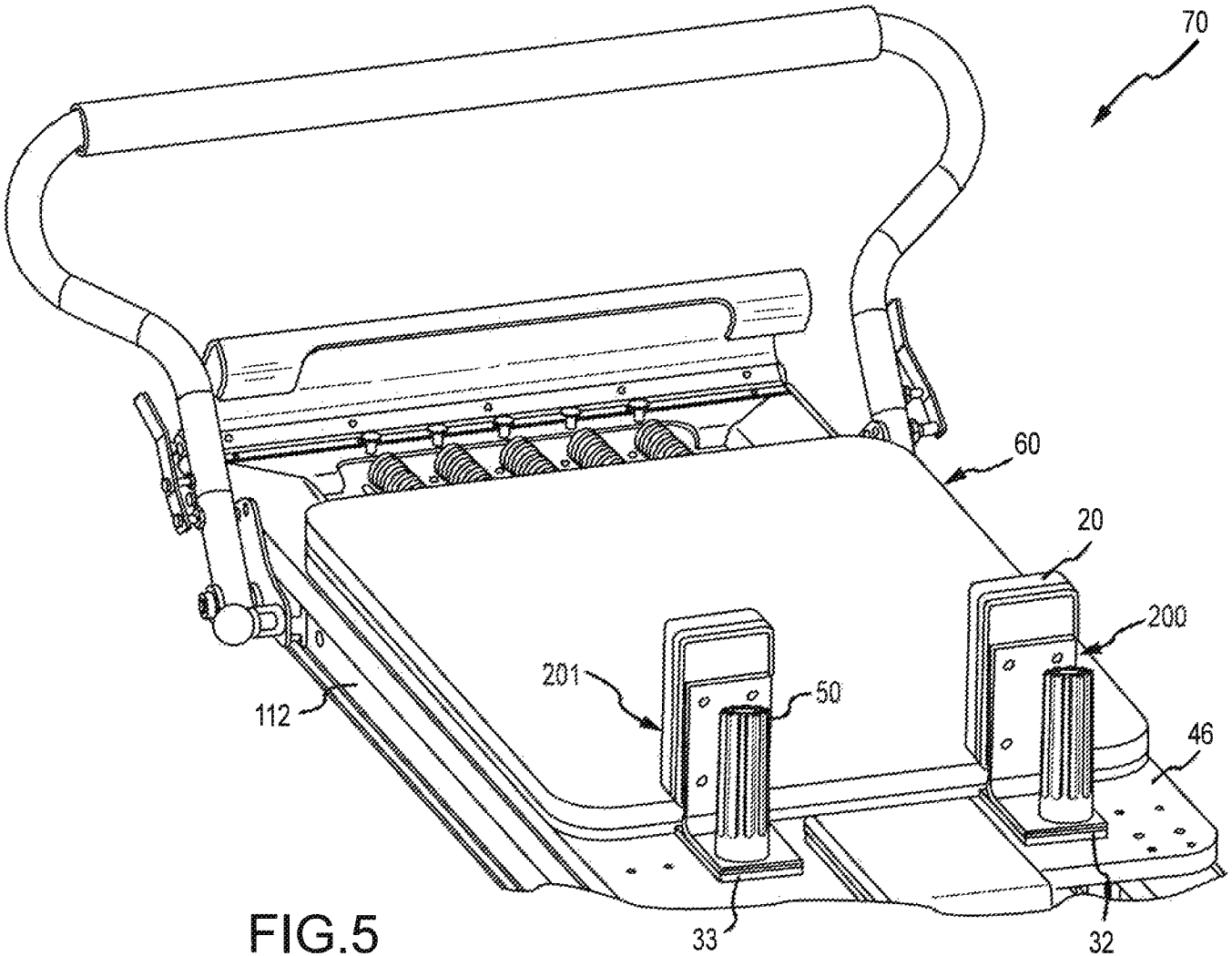
FIG. 5 is a partial perspective top view of a reformer exercise apparatus and a pair of removable shoulder stop assemblies mounted thereto.

The removable shoulder stop assembly 100 may be utilized in conjunction with any apparatus that might benefit from one or more shoulder stops, such as any form of exercise apparatus that requires a stop for a portion of a user's body. Turning now to FIGS. 4-5, a pair of removable shoulder stop assemblies 100, 101 may be mounted, via lock plates 32, to a planar surface of an exercise apparatus 70. The exercise apparatus 70 includes a frame 112 and a movable carriage 60 mounted on the frame 112 for movement away from and toward a foot end of the frame shown. In the embodiment depicted, the frame 112 is generally rectangular and defines a frame longitudinal axis. The carriage 60 is moveable along the frame longitudinal axis and has a generally flat platform for supporting a portion of a user's body.

In one embodiment, and as best shown in FIG. 4, the key pins 11, 30 are each laterally spaced to one side of a longitudinal center line 57 of the mounting flange 28. The complementary rectangular mounting or lock plate 32 is fastened to the upper surface of the carriage platform 46 via the lock plate mounting screws 58. Each of the keyways 34 and 35 has a recessed cutout portion 62 and 64 to receive the heads 66 and 68 respectively of the key pins 11, 30.

In this embodiment, the keyway slots 34, 35 of the lock plate 32 are also spaced to the same side of a longitudinal centerline 59 of lock plate 32. The right shoulder stop 200 shown in FIG. 5 has its key pins spaced to the right of the centerline of the angle bracket plate 32. The left shoulder stop 201 shown in FIG. 5 has its key pins spaced to the left of the centerline of the lock plate 33. Consequently, if the shoulder stops 200 and 201 are swapped, the spacing between them will be wider. Conversely, if the mounting plates 32, 33 were reversed on carriage platform 46, then, if the shoulder stops 200 and 201 were swapped, the alternative arrangement would produce a narrower spacing therebetween. Accordingly, the user may select a choice between normal lateral spacing and wide lateral spacing with one arrangement of the mounting plates 32, 33 and may alternatively select a choice between normal lateral spacing and narrow lateral spacing by simply swapping the locking plate locations on the carriage platform 46.

Turning back to FIG. 3, in those embodiments that include a clevis pin 48 in addition to the user-selectable shoulder stop spacing described above, the lock plate 32 may include an additional clevis pin hole 53 to allow the shoulder stop bracket to be locked in place when configured in the alternate arrangement (i.e. right shoulder stop 200 mounted to left lock plate 33, and vice versa).

In an alternative embodiment (not pictured), the key pin 11 and the second keyway 35 are swapped between the shoulder stop bracket 26 and the lock plate 32. In other words, the first locating member (located on the lock plate) is a key pin and the second locating member (located on the shoulder stop bracket) is a keyway. Other configurations of the first and second locating members can be envisioned. For example, in some embodiments, the clevis pin and clevis pin hole may serve as the first and second locating members, respectively.

Figure 6:
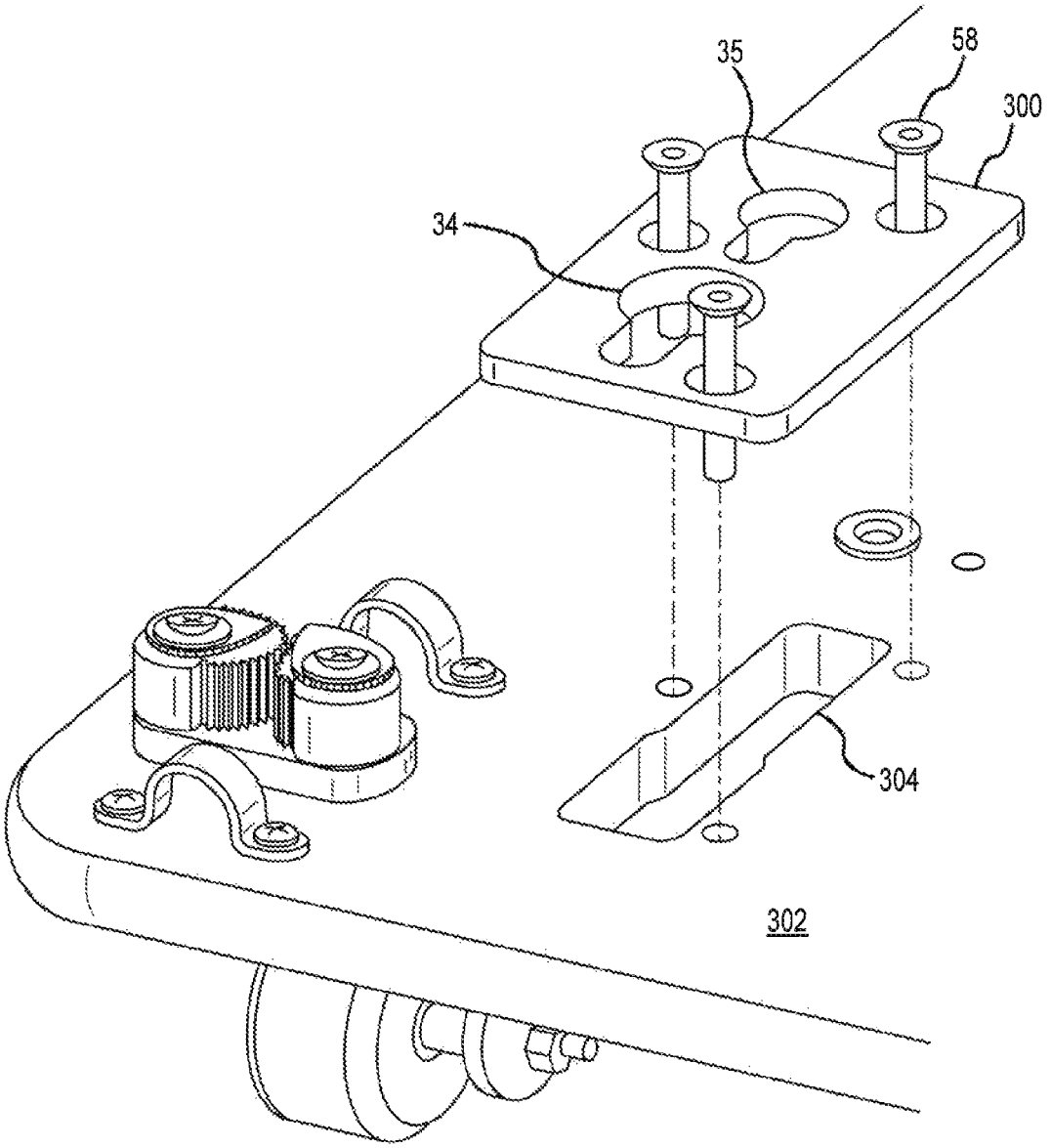
FIG. 6 is a partial perspective exploded view of a reformer carriage with a removable shoulder stop lock plate in accordance with an alternative embodiment of the present disclosure.

Another embodiment of a removable shoulder stop assembly lock plate 300 for use in an assembly 100 in accordance with the present disclosure is shown in a perspective exploded view above a reformer carriage 302 in FIG. 6. The lock plate 300 is simply a flat rectangular plate with keyways 34 and 35 as above described. In order to accommodate the heads of the key pins 30 and 11, a recess 304 is routed, or otherwise formed, in the upper surface of the carriage 302.

Figure 7:
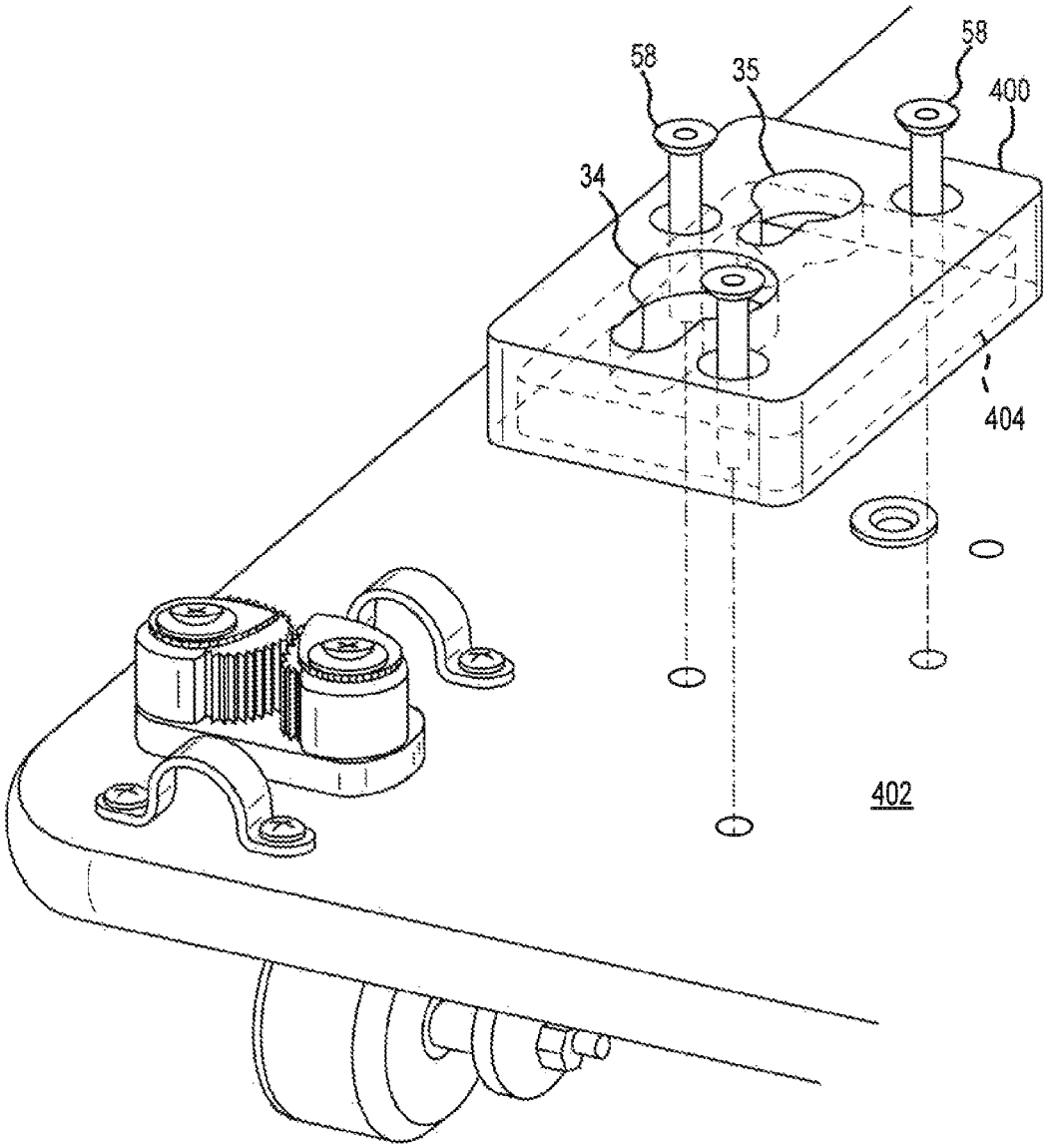
FIG. 7 is a partial perspective exploded view of a reformer carriage with another removable shoulder stop lock plate in accordance with an alternative embodiment of the present disclosure.

A further embodiment of a removable shoulder stop assembly lock plate 400 for use in an assembly 100 in accordance with the present disclosure for mounting on a carriage 402 that does not have a recess in its upper surface is shown in a perspective view of FIG. 7. The lock plate 400 in this embodiment is a thicker plate that has a hollow recess 404 to accommodate the heads of the key pins 30 and 11 shown in FIGS. 1-3.

The above description is given by way of example, and not limitation. Given the above disclosure, one skilled in the art could devise variations that are within the scope and spirit of the invention disclosed herein. For example, the shoulder stop assembly may include a lever operated cam assembly instead of, or in addition to, the locking handle assembly described above in order to draw shoulder stop bracket to the locking plate 32. Additionally, while the figures herein generally depict the removable shoulder stop assembly being mounted with the cushion pads in a vertical position, the shoulder stop assembly may be mounted in any spatial orientation, including vertical, horizontal, at an angle, facing towards or away from the ground, etc.

Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. An exercise apparatus comprising:

a rectangular frame defining a frame longitudinal axis;

a carriage mounted on the frame having a generally flat platform for supporting a portion of a user's body and movable along the frame longitudinal axis;

a removable shoulder stop assembly for mounting on an exercise apparatus, the shoulder stop assembly comprising:

a flat rectangular lock plate fastenable to a planar surface, the lock plate having a first locating member and a keyway spaced from the first locating member;

an L-shaped shoulder stop bracket having a pad support flange and a mounting flange generally perpendicular to the pad support flange, the mounting flange having a second locating member configured to mate with the first locating member;

a shoulder pad fastened to the pad support flange of the shoulder stop bracket; and a locking handle assembly mounted on the mounting flange of the bracket and spaced apart from the second locating member so as to align with the keyway when the first locating member is mated with the second locating member and operable to clamp the shoulder stop bracket to the lock plate when the locating members are mated and the locking handle assembly is hand tightened by rotation against the shoulder stop bracket.

2. The exercise apparatus according to claim 1 wherein the locking handle assembly comprises an elongated cylindrical handle threaded onto a bolt having a head sized to fit into the keyway.

3. A removable locking shoulder stop assembly for use on a reformer exercise apparatus having a rectangular frame supporting a carriage for reciprocal movement between side rails of the frame, the carriage having a generally flat platform for supporting a user's body thereon and having a head rest at one end of the carriage platform, the shoulder stop assembly comprising:

a flat rectangular lock plate fastenable to a surface portion of the platform adjacent the head rest at the one end of the carriage platform, the lock plate having a first locating member and a keyway spaced from the first locating member;

an L-shaped shoulder stop bracket having a pad support portion and a mounting portion generally perpendicular to the pad support portion, the mounting portion having a second locating member configured to mate with the first locating member of the lock plate; and an elongated locking handle assembly connected to the mounting portion of the bracket and spaced apart from the second locating member, wherein the handle assembly aligns with the keyway when the first locating member is mated with the second locating member and wherein the handle assembly is operable to clamp the shoulder stop bracket to the lock plate when the locating members are mated and the locking handle assembly is hand tightened by rotation against the mounting portion of the shoulder stop bracket.

4. The removable shoulder stop assembly according to claim 3 wherein the rectangular lock plate has a bottom and a flat top, wherein the bottom is fastenable to the carriage platform, the bottom having a recess encompassing the keyway.

5. The removable shoulder stop assembly according to claim 4 wherein the recess encompasses the keyway and the first locating member.

6. The removable shoulder stop assembly according to claim 4 wherein the handle assembly includes a bolt having a head that fits through the keyway into the recess.

7. The removable shoulder stop assembly according to claim 3 wherein the first locating member is a pin projecting from the mounting portion of the bracket and the handle assembly includes a bolt extending through the mounting portion of the bracket.

8. The removable shoulder stop assembly according to claim 7 wherein the first locating member pin is adjacent the shoulder pad support portion of the bracket and the handle assembly is spaced away from the first locating member pin and the shoulder pad support portion of the bracket.

9. The removable shoulder stop assembly according to claim 3 further comprising a shoulder cushion pad fastened to the pad support portion of the stop bracket.

10. The removable shoulder stop assembly according to claim 3 wherein the handle assembly includes a cylindrical sleeve handle threaded onto a bolt having a head, the head protruding from a bottom end of the handle and being sized to fit within and be held in the keyway in the lock plate when the cylindrical sleeve handle of the handle assembly is tightened to fasten the bracket to the lock plate.

11. A removable locking shoulder stop assembly for use on a reformer exercise apparatus having a rectangular frame supporting a carriage for reciprocal movement between side rails of the frame, the carriage having a generally flat platform for supporting a user's body thereon and having a head rest at one end of the carriage platform, the shoulder stop assembly comprising:

a flat rectangular lock plate fastenable to a surface portion of the platform adjacent the head rest at the one end of the carriage platform, the lock plate having a first locating member and a keyway spaced from the first locating member;

an L-shaped shoulder stop bracket having a pad support portion and a mounting portion generally perpendicular to the pad support portion, the mounting portion having a second locating member configured to mate with the first locating member of the lock plate;

an elongated locking handle assembly connected to the mounting portion of the bracket and spaced apart from the second locating member, wherein the handle assembly aligns with the keyway when the first locating member is mated with the second locating member and wherein the handle assembly is operable to clamp the shoulder stop bracket to the lock plate when the locating members are mated and the locking handle assembly is hand tightened against the mounting portion of the shoulder stop bracket, wherein the handle assembly includes a cylindrical sleeve handle threaded onto a bolt having a head, the head protruding from a bottom end of the handle and being sized to fit within and be held in the keyway in the lock plate when the cylindrical sleeve handle of the handle assembly is tightened to fasten the bracket to the lock plate, and further comprising a spacer on the bolt sandwiched between two washers and captured on the bolt between the head and a nut.

12. The removable shoulder stop assembly according to claim 11 wherein the spacer is a sleeve having straight sides.

* * * * *